United States Patent [19]

Johnson

[11] Patent Number: 4,818,172

[45] Date of Patent: Apr. 4, 1989

[54] PARASITIC CRANE

[75] Inventor: Bruce S. Johnson, Burbank, Calif.

[73] Assignee: Harsco Corporation, Wormleysburg, Pa.

[21] Appl. No.: 89,084

[22] Filed: Aug. 25, 1987

[51] Int. Cl.[4] ..... B66C 23/00

[52] U.S. Cl. ..... 414/686; 212/189; 414/547; 414/550; 414/688; 414/705

[58] Field of Search ..... 414/560, 680, 685–688, 414/733, 734, 738, 744 R, 546, 547, 549, 550, 553, 563, 607, 608, 626, 705; 212/179, 180, 184, 189, 199, 203

[56] References Cited

U.S. PATENT DOCUMENTS

| | | | |
|---|---|---|---|
| 2,261,478 | 6/1940 | Tourneau | 212/175 |
| 3,023,914 | 3/1962 | McGuire et al. | 212/189 |
| 3,302,229 | 2/1967 | Teague, Jr. | 414/607 X |
| 3,351,221 | 11/1967 | Smalley | 212/189 X |
| 3,404,792 | 10/1968 | Frieberg | 414/550 X |
| 3,433,459 | 3/1969 | Logan | 414/626 X |
| 3,587,893 | 6/1971 | Laken | 414/563 X |
| 3,685,673 | 8/1972 | Schweis | 212/189 X |
| 3,780,877 | 12/1973 | Levitt | 212/189 |
| 3,794,296 | 2/1974 | Hasstedt | 212/189 X |
| 3,795,332 | 3/1974 | Eriksson | 414/550 X |
| 3,825,132 | 7/1974 | Colangelo | 414/563 |
| 3,939,988 | 2/1976 | Wellman | 212/184 X |
| 4,058,229 | 11/1977 | Triplett | 414/546 |
| 4,150,754 | 4/1979 | Schmitt | 414/680 X |
| 4,226,331 | 10/1980 | Dumond | 414/686 X |
| 4,596,336 | 6/1986 | Zwagerman | 212/199 X |
| 4,597,712 | 7/1986 | Smith | 212/189 X |
| 4,648,780 | 3/1987 | Harms et al. | 414/686 |
| 4,666,360 | 5/1987 | Harms et al. | 414/607 |
| 4,690,609 | 9/1987 | Brown | 414/560 X |

*Primary Examiner*—Robert J. Spar
*Assistant Examiner*—David A. Bucci
*Attorney, Agent, or Firm*—Kerkam, Stowell, Kondracki & Clarke

[57] ABSTRACT

A crane has a twin post and a twin boom construction and provides for numerous degrees of freedom. The crane is a trailer and uses the weight of a vehicle to which it is attached for stability when it is in an operating mode. The crane has wheels which may be lifted off the ground to allow its positioning by a vehicle to which it is attached.

26 Claims, 6 Drawing Sheets

PARASITIC CRANE

BACKGROUND OF THE INVENTION

This invention relates to cranes and, more specifically, to a parasitic crane which attaches to a vehicle and uses the weight of the vehicle to stabilize it against tipping when holding a load.

Various cranes have heretofore been used for loading and unloading vehicles or otherwise moving loads. Although such cranes are generally useful, they have usually been subject to one or more of several disadvantages.

Prior art cranes are often quite heavy, the weight being used to stabilize the crane and allow it to lift relatively heavy loads. Such heavy cranes are difficult to transport from one location to another and often must include their own power plant for moving the base of the crane. Cranes are often difficult to position quickly and efficiently, especially when other vehicles are quite close. Some cranes are limited to moving loads from a given starting point to a given unloading point along a fixed path and are quite efficient at moving loads along the path. However, the limitation of such cranes to the given load movement path requires the movement of loads to the starting point before the crane can lift them. On the other hand, cranes which are not as limited in their load movement paths are often slower at moving loads than the fixed path type of cranes.

Some cranes have previously been constructed to move like trailers when pulled by another vehicle. However, lack of stability, difficulty in maneuvering, complexity in construction, and the need for time consuming steps to reconfigure such devices between their crane and trailer configurations are among numerous problems common to such prior designs.

Cranes have often been inadequate for moving loads under battlefield conditions. Lack of sufficient reliability and inability to withstand nearby explosions are among factors which hinder the use of cranes to move materials in support of Army field operations.

OBJECTS AND SUMMARY OF THE INVENTION

Accordingly, it is a primary object of the present invention to provide a new and improved crane.

A more specific object of the present invention is to provide a crane which is relatively light in weight.

Another object of the present invention is to provide a crane which uses the weight of another vehicle to provide its stability.

A further object of the present invention is to provide a crane which is relatively simple in construction.

A still further object of the present invention is to provide a crane which may be pulled as a trailer.

Yet another object of the present invention is to provide a crane which is easily maneuverable and easily operated.

Another object of the present invention is to provide a crane which will very quickly move loads from a given starting point to a given unloading point, but at the same time provide flexibility such that the starting point and unloading point may easily be changed.

A still further object of the present invention is to provide a crane which is sufficiently reliable and durable for usage under battlefield conditions to support Army units.

The above and other objects of the present invention including the avoidance or minimizing of the disadvantages discussed above with respect to the prior art cranes are realized by a crane comprising: a frame assembly; first and second posts mounted to the frame assembly adjacent opposite sides thereof and extending up; a coupler mounted to an inner side of the frame assembly and operable to removably couple the frame to a vehicle; first and second booms, the first boom having an inner end mounted at a first pivot axis to the first post and an outer end, the second boom having an inner end mounted at a second pivot axis to the second post and an outer end; a cross-head attached to the outer end of the first boom and the outer end of the second boom; and a load support attached to the cross-head and operable to support loads attached thereto for movement by the crane. The first and second booms are respectively pivotable in unison about the first and second pivot axes over a range of at least 30° above horizontal in an outer direction (towards an outer side opposite the inner side) through 30° above horizontal in an inner direction towards the inner side. The crane is operable to move loads between the outer side and the inner side with the load support passing through a plane defined by the first and second booms. The first and second pivot axes are both horizontal and the first and second booms are pivotable in unison over a range of at least below horizontal on the outer side to horizontal on the inner side. Each of the posts includes an upper part and a lower part and each upper part is vertically movable relative to each lower part to move the first and second booms. Each of the booms include an inner part and an outer part movable relative to the inner part to change the straight line distance between the inner and outer ends. The cross-head is mounted to each of the inner ends to allow it to pivot about a horizontal axis relative to the first and second booms. Each of the first and second booms is rotatable about a vertical axis and the cross-head is mounted to each of the inner ends such that the angles between the cross-head and the first and second booms vary with rotation of the first and second booms. The crane further comprises a pair of wheels supporting the frame assembly, the crane being operable to function as a trailer. The crane further comprises a first support leg pivotably connected to the frame assembly and the crane is disposable in: an operating position for lifting loads with the coupler attached to a vehicle such that the vehicle counter-balances any tendency of the crane to tip when supporting a load by the first boom extending away from the vehicle; a stand-alone position with the crane supported by the first support leg pivoted to a lower position; and a towing position such that the crane is securable to a vehicle and having the first support leg pivoted to an upper position above its lower position. The crane further comprises a frame lifter operable to lift at least a portion of the frame assembly relative to the ground when the coupler is coupled to a vehicle to allow positioning of the crane by the vehicle while the crane is completely removed from the ground.

The present invention may alternately be described as a crane comprising: a frame assembly; first and second posts mounted to the frame assembly adjacent opposite sides thereof and extending up; first and second booms, the first boom having an inner end mounted at a first pivot axis to the first post and an outer end, the second boom having an inner end mounted at a second pivot axis to the second post and an outer end; a cross-head attached to the outer end of the first boom and the outer end of the second boom; and a load support attached to the cross-head and operable to support loads attached thereto for movement by the crane. Each of the first and second booms is rotatable about a vertical axis and the cross-head is mounted to each of the outer ends such that the angles between the cross-head and the first and second booms vary with rotation in unison of both of the first and second booms. The cross-head is attached to each of the first and second booms by a ball and socket. The load support comprises a fork assembly having a hydraulically operated fork to lift and hook objects.

The invention may alternately be described as a crane comprising: a frame assembly; a pair of wheels supporting the frame assembly; a coupler mounted to a side of the frame assembly and operable to removably couple the crane to a vehicle; at least a first post mounted to the frame assembly; at least a first boom having an inner end mounted to the first post and an outer end; a load support supported by the outer end for supporting loads lifted by the crane; and at least a first support leg pivotably mounted to the frame assembly. The crane is disposable in: an operating position for lifting loads with the coupler attached to the vehicle such that the vehicle counter-balances any tendency of the crane to tip when supporting a load by the first boom extending away from the vehicle; a stand-alone position with the crane supported by the first support leg pivoted to a lower position; and a towing position such that the crane is securable to a vehicle and having the first support leg pivoted to an upper position above its lower position and with the first support leg secured to the first boom. The coupler is mounted to an inner side of the frame assembly and is operable to couple the crane to a vehicle with the inner side facing the vehicle. The frame assembly has an outer side, which is opposite the inner side, and which faces the vehicle when the crane is in its towing position and secured to a vehicle. The crane further comprises a second post, a second boom, and a second support leg constructed and operable in like fashion respectively to the first post, first boom, and first support leg. A cross-head is attached between the first and second booms and the load support is mounted thereon. The crane further comprises a towing fastener mounted to the cross-head for allowing a vehicle to pull the crane when it is in its towing position by way of the towing fastener.

The present invention may alternately be described as a crane comprising: a frame assembly; a first post mounted and extending up from the frame assembly; a coupler mounted to an inner side of the frame assembly and operable to removably couple the crane to a vehicle; a first boom having an inner end mounted to the first post and an outer end; a load support supported by the outer end for supporting loads lifted by the crane; and a frame lifter operable to lift at least a portion of the frame assembly relative to the ground when the coupler is coupled to a vehicle to allow positioning of the crane by the vehicle while the crane is completely removed from the ground. The frame assembly includes a main frame and a base frame, and the coupler is mounted to the main frame and the frame lifter lifts the base frame relative to the main frame. The crane further comprises a second post and a second boom constructed and operable in like fashion respectively to the first post and the first boom.

The above and other features of the present invention will be more readily understood when the following detailed description is considered in conjunction with the accompanying drawings wherein like characters represent like parts throughout the several views and in which.

Figure 3:
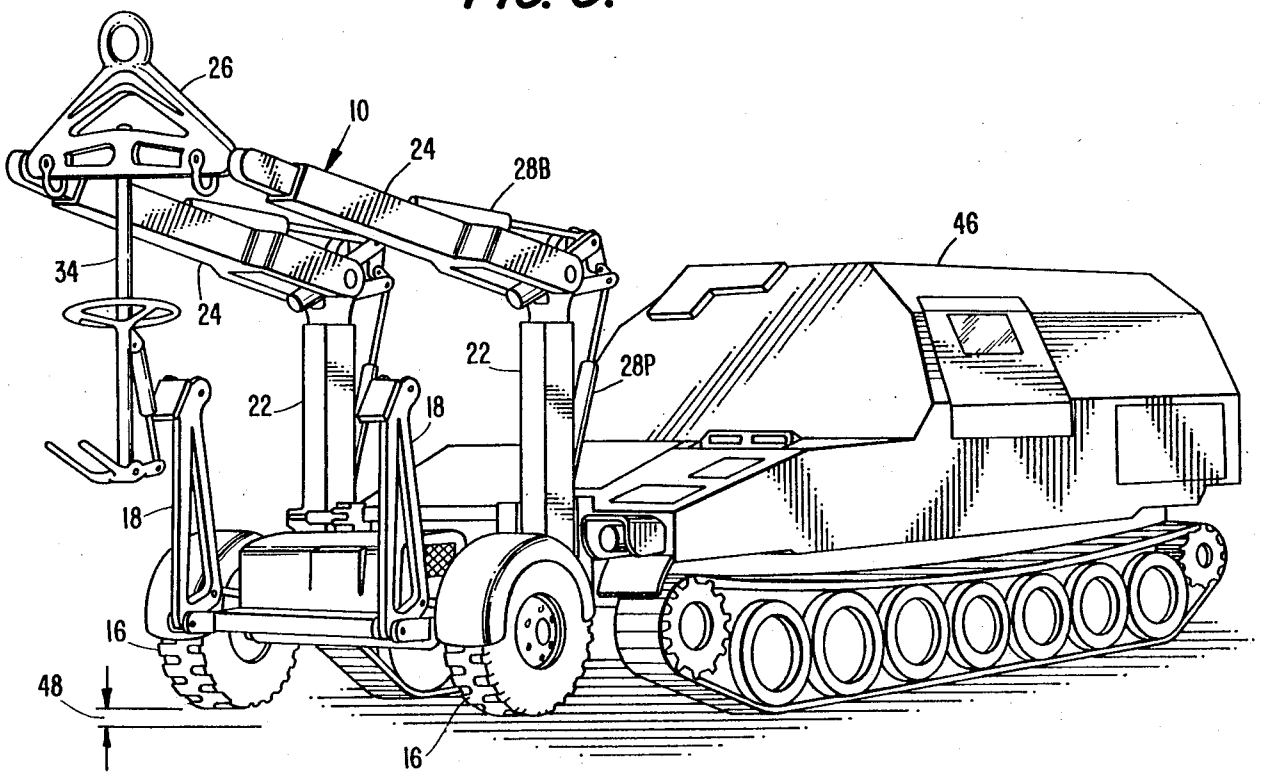
FIG. 3 shows a perspective view of the first embodiment crane of the present invention when disposed in a maneuvering configuration and attached to an armored vehicle.
Figure 4:
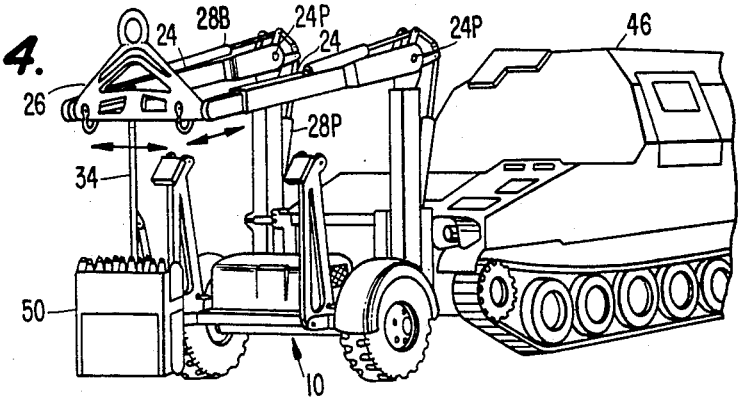
FIG. 4 shows the same perspective view as FIG. 3 with the crane in an operation configuration engaging a load.

FIGS. 5, 6, 7, and 8 show the same perspective as FIGS. 3 and 4 sequentially illustrating the operations of the crane.

Figure 9:
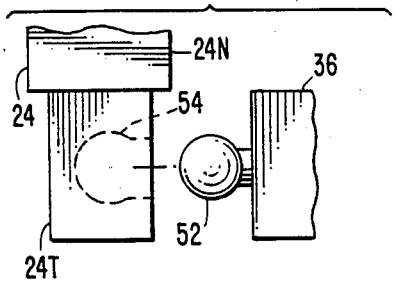

FIG. 9 shows a ball and socket joint used with the present invention.

Figure 10:
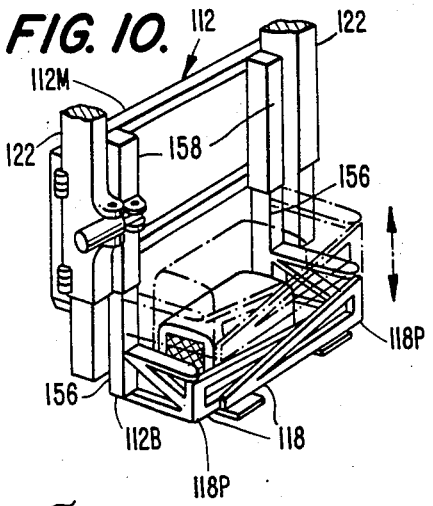

FIG. 10 shows a perspective of a frame assembly of a second embodiment crane of the present invention.

Figure 11:
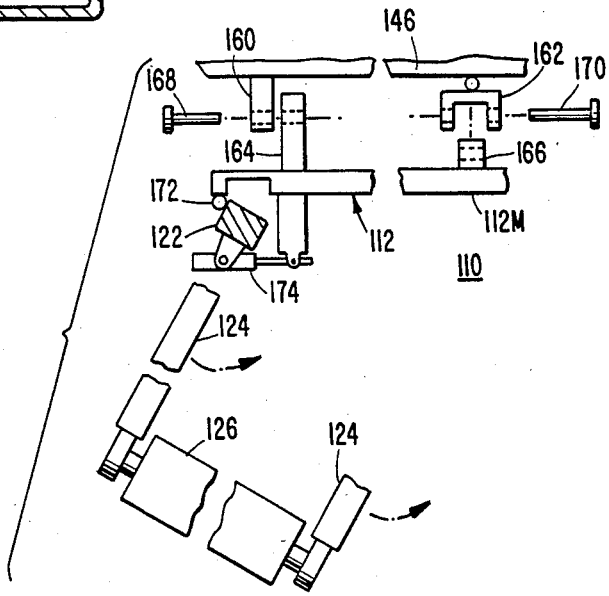

FIG. 11 shows a simplified top view of the second embodiment of the present invention.

Figure 12:
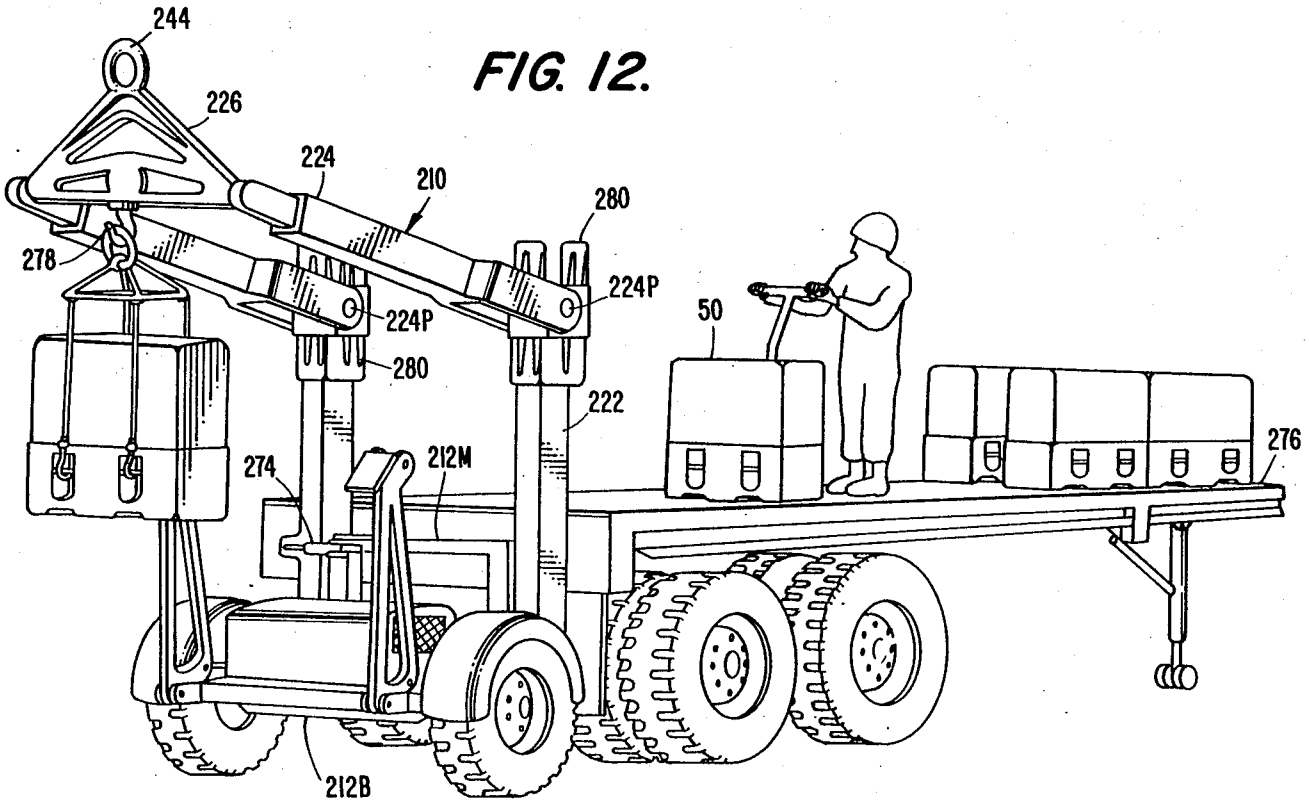

FIG. 12 shows a third embodiment of the present invention.

Figure 13:
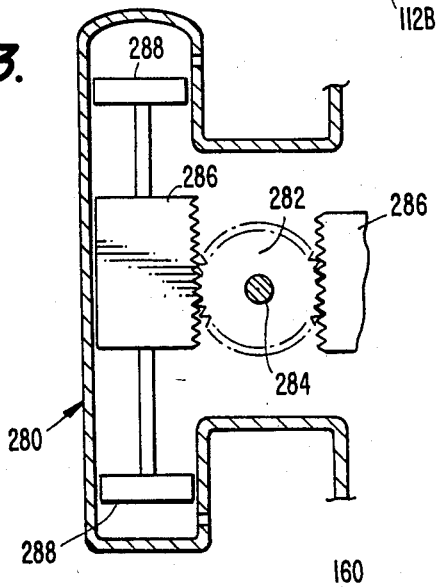

FIG. 13 shows a simplified view with parts broken away of an actuator which may be used with the third embodiment.

DETAILED DESCRIPTION

Figure 1:
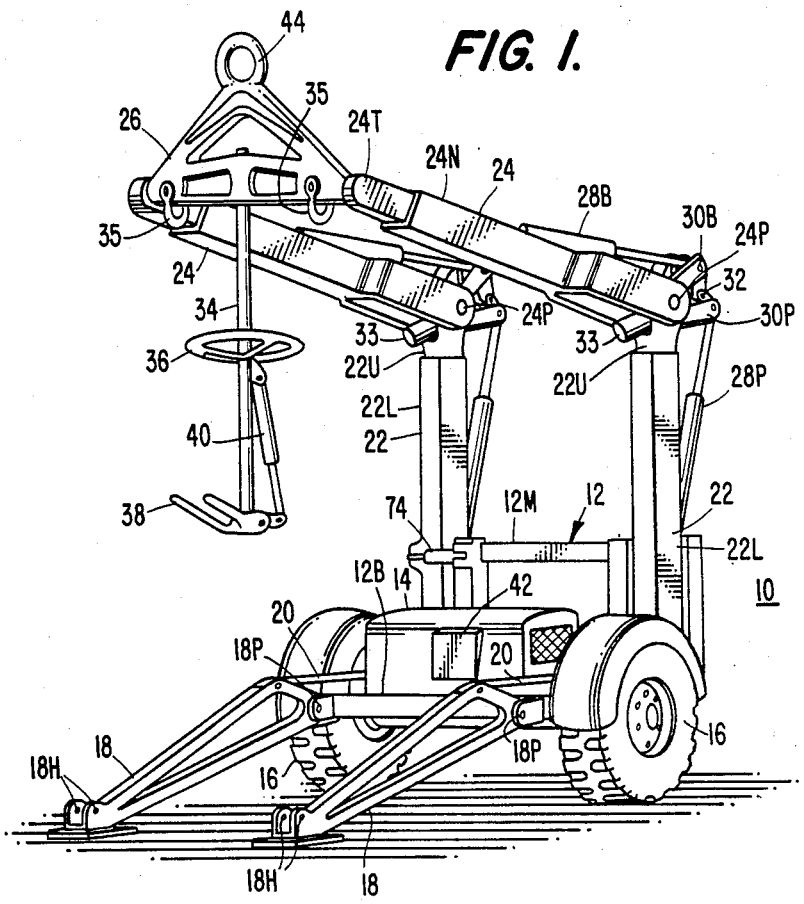
FIG. 1 shows a perspective view of a first embodiment of the present invention in a stand-alone configuration.
Figure 2:
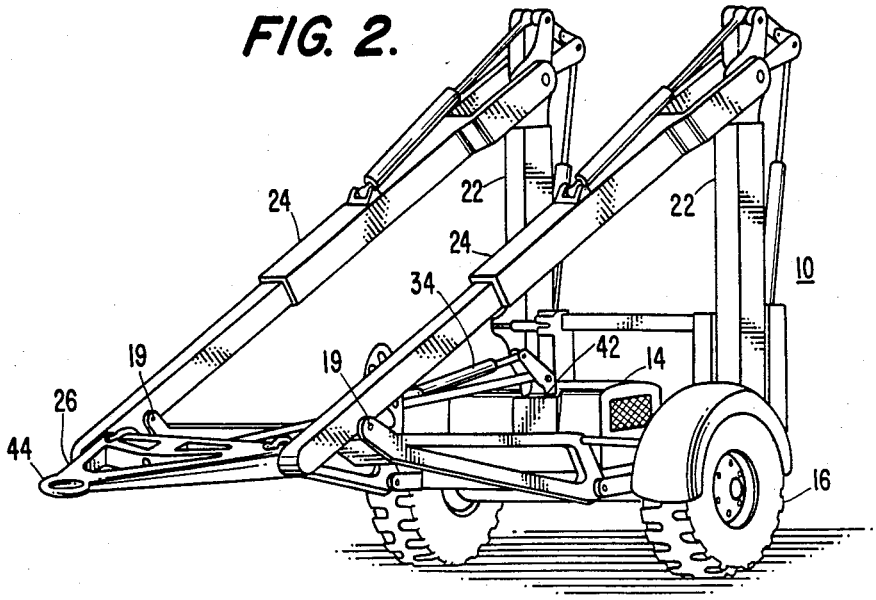
FIG. 2 shows a perspective view of the first embodiment in a towing configuration.

The crane 10 of the present invention is illustrated in FIGS. 1, 2, and 3 respectively disposed in a stand-alone configuration, a towing configuration, and a maneuvering configuration. The crane has a frame assembly 12 comprised of a main frame 12M and a base frame 12B. The base frame 12B has a power unit 14 mounted thereon and which would include a two cylinder diesel engine and a hydraulic pump (not separately identified). The hydraulic pump is used to control various hydraulic actuators on the crane 10 and the power unit 14 would also include an electric generator (not separately identified) to power various electric valve controls and accessories for the crane 10.

The crane includes numerous hydraulic devices such as cylinders discussed in detail below. The hydraulic devices are controlled by electric solenoids operated by a control box on a cable and having manual control levers as back up controls, but these need not be shown or discussed in detail as the specifics for controlling the hydraulic devices are not central to the present invention.

The base frame 12B has two wheels 16 mounted thereon. Two support legs 18 are pivotably mounted to the base frame 12B at points 18P. Each of the support legs 18 is pivoted by operation of support leg hydraulic actuators 20 (only partially visible) which are pivotably connected at one end to the corresponding support leg 18 and pivotably connected at the other end (not visible) to the base frame 12B.

Mounted to the main frame 12M are twin posts 22, each of which includes a lower part 22L and an upper part 22U. The upper parts 22U function as pistons which are hydraulically operable to telescope in and out of the lower parts 22L. A pair of booms 24, each having an inner part 24N and an outer part 24T, are pivotably mounted at pivot points 24P to the top of post 22. A cross-head 26 extends between the outer ends of booms 24. The booms 24 can be hydraulically adjusted in length by varying the positions of the outer parts 24T relative to the inner parts 24N. Each of the booms 24 can be adjusted over a wide angular range relative to its corresponding post 22 by operation of the hydraulic cylinders 28P and 28B. Each of the cylinders 28B has an end (not visible in these figures) pivotably connected to an upper surface of boom 24 and an opposite end pivotably connected to plates 30B, which plates are in turn pivotably mounted to the shaft extending through pivot axis 24P. Also mounted to the shaft extending through pivot axis 24P is a plate 30P, which is connected by linkage 32 to the plates 30B. The linkages 32 may be moved by hydraulic cylinder 33. As discussed in more detail below, the actuators 28B and 28P allow the booms 24 to be rotated over 180° from below horizontal in an outer direction (left side of FIGS. 1 and 2 and away from the vehicle in FIG. 3) to at least horizontal in an opposite inner direction and, preferably, below horizontal in the inner direction.

Mounted upon the cross-head 26 are eyelets 35 and a fork assembly 34 having a maneuvering ring 36 and forks 38 mounted for pivoting by operation of cylinder 40. As discussed in detail below, the fork assembly 34 is designed to pick up a particular type of battlefield magazine.

In FIG. 1 the crane 10 is in its stand-alone configurations with the support legs 18 pivoted to lower positions by operation of the actuators 20. Accordingly, the crane will be supported by the wheels 16 and the ends of the support legs 18. The crane 10 is relatively lightweight and therefore requires attachment to a vehicle to stabilize it against tipping when lifting a load. The crane 10 disposed in its stand-alone configuration of FIG. 1 is not suitable for lifting most loads.

In FIG. 2, the booms 24 have been extended in length and tilted below horizontal such that they may be joined with support legs 18 which are tilted to a position above the lower position of FIG. 1. In the position of FIG. 2, the support legs 18 may be pinned to the booms 24 by extending a pin 19 through the pairs of holes 18H in the ends of the support legs 18. Each of the pins 19 (FIG. 2 only) may extend through the holes 18H (FIG. 1) and through corresponding holes (not visible) in the ends of the booms 24. The towing configuration of FIG. 2 additionally has the crosshead 26 rotated such that the forks 28 may fit within compartment 42 and a towing ring 44 will project out generally horizontally from the crane 10 such that it may be connected to a towing hitch (not shown) of a vehicle for towing the crane 10.

As shown in FIG. 3, the crane 10 may be attached to a vehicle 46 in a maneuvering configuration with each of the wheels 16 lifted off the ground by a distance 48. In the configuration of FIG. 3, the crane 10 is completely supported by the vehicle 46 and is not contacting the ground. Accordingly, the vehicle 46, which is field artillery ammunition supply vehicle, may easily maneuver the crane 10 into a desired position. The vehicle 46 has treads which allow it to easily maneuver in mud, snow, or other difficult terrain conditions. Once the crane 10 has been moved to a proper place for loading or unloading the supply vehicle 46, the wheels 16 of crane 10 may be lowered to contact the ground. The details of lifting and lowering of the wheels 16 of crane 10 by the attachment to a vehicle such as 46 will be discussed in detail below. It should be noted that the support legs 18 have been pivoted to uppermost positions in FIG. 3 above the lower positions of FIG. 1 and above the upper (but intermediate) positions of FIG. 2.

With reference now to FIGS. 4–8, the operation of the crane 10 for loading the ammunition supply vehicle 46 will be discussed in detail. In the view of FIG. 4, the crane 10 has been changed from its maneuvering configuration of FIG. 3 such that the wheels 16 now rest upon the ground. The booms 24 are adjusted in length such that the fork assembly 34 is disposed adjacent a battlefield magazine 50 which may include slots (not shown) for accommodating the fork tines 38 (not visible in FIGS. 4–8). For ease of illustration, the maneuvering ring 36 is left out of FIGS. 4–8. However, the maneuvering ring 36 is operated such that the fork tines 38 hook the battlefield magazine 50 and lift it upwardly as the booms 24 pivot about parallel horizontal axes corresponding to 24P. Operation of the cylinders 28B and 28P is used to change the angle of the booms 24. As the cross-head 26 is mounted to each of the two booms 24 by a ball and socket joint, the cross-head 26 may readily pivot about a horizontal axis such that the shaft of fork assembly 34 maintains its vertical orientation. With momentary reference to FIG. 9, it will be seen that each of the ends of cross-head 36 (only one end is shown) includes a ball 52 which fits within a corresponding socket 54 in the outer part 24T of each boom 24. The ball 52 serves as a pivot means on the crosshead 36 to allow pivoting of the crosshead 36 about a horizontal axis and to allow variation in the angles between the crosshead and the booms.

Figure 5:
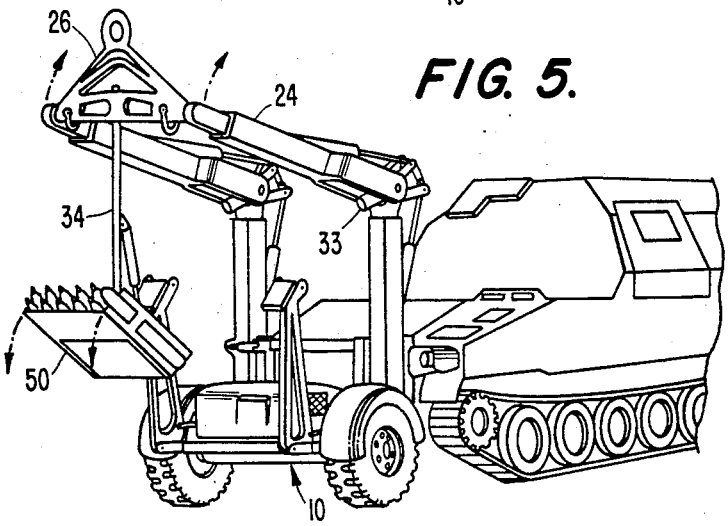
Figure 6:
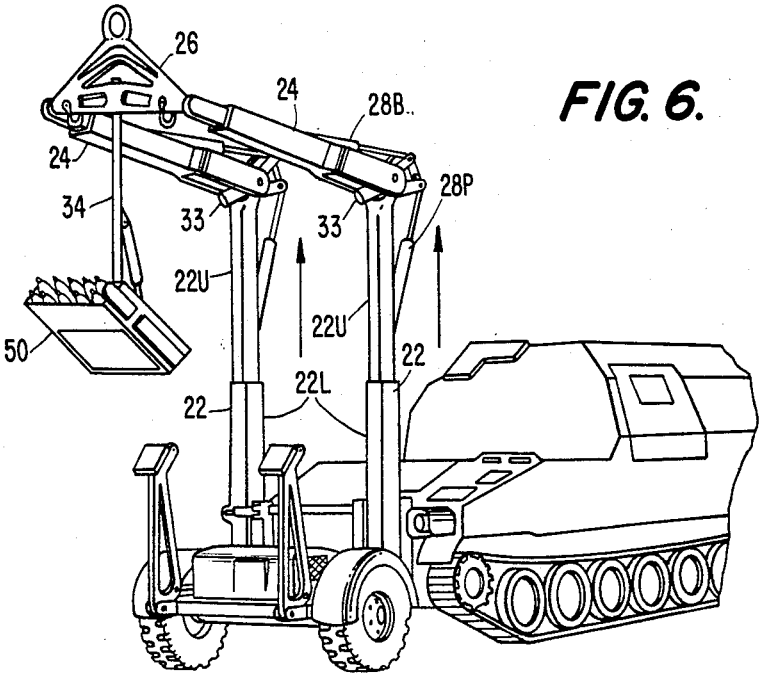
Figure 7:
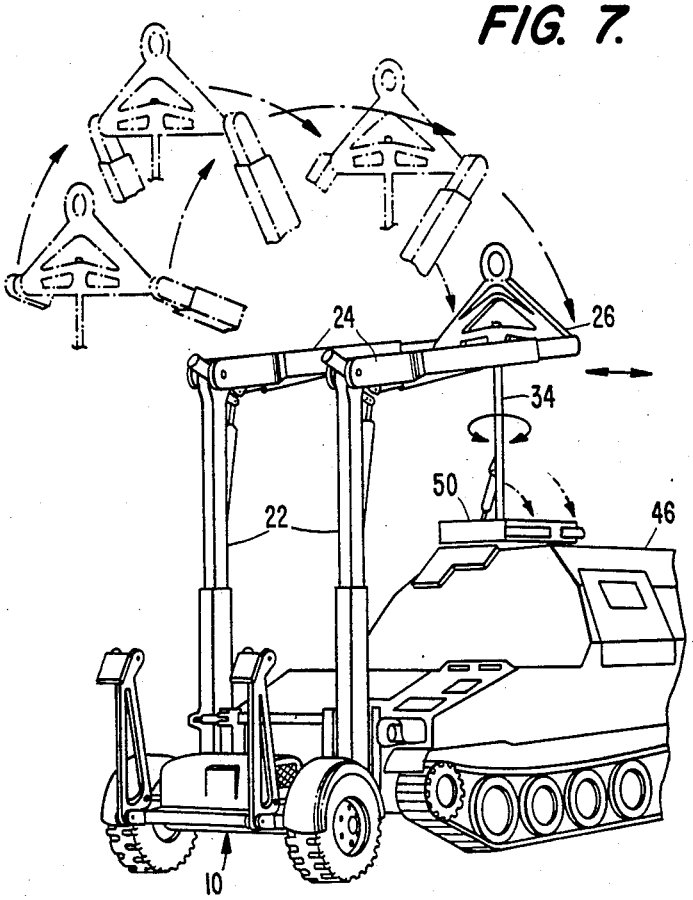
Figure 8:
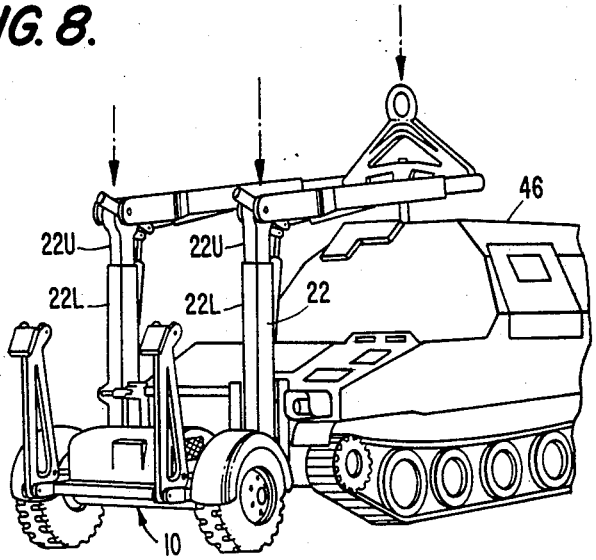

When the crane 10 has moved the battlefield magazine 50 to the FIG. 5 position, the upper parts 22U of the post 22 may be hydraulically pushed up from the lower parts 22L, it being noted that each pair of parts 22U and 22L serve as a hydraulic piston and cylinder respectively. When the upper parts 22U are moved to the position of FIG. 6, the booms 24 may then be tilted over such that the battlefield magazine 50 travels through the vertical plane defined by the parallel twin post 22. The booms 24 are tilted by operation of the cylinders 28P, 28B, and 33 which are part of a knuckle joint at the intersection between booms 24 and posts 22. It should be noted that the fork assembly 34 is pivotably mounted to the crosshead 26 such that it may rotate about a vertical axis parallel to the shafts of fork assembly 34 allowing one to reorient the battlefield magazine 50 as it is lowered to the top of vehicle 46 in the position illustrated in FIG. 7. The upper part of the post 22U may then be retracted into the lower part 22L of the posts 22 to assume the FIG. 8 position such that the battlefield magazine 50 (no longer visible in FIG. 8) is disposed within the ammunition supply vehicle 46. The battlefield magazine may then be removed from the fork assembly 34 and the crane 10 may reverse the sequence of operations of FIGS. 4–8 until the crane 10 reassumes it FIG. 4 position and may pick up another battlefield magazine 50.

FIG. 10 shows an alternate embodiment frame assembly 112 according to the present invention. Because the frame assembly 112 is generally similar to the frame assembly 12 of the FIG. 1 embodiment, the view of FIG. 10 will be used to discuss the feature allowing the wheels 16 to be lifted off the ground in the fashion illustrated in FIG. 3. In FIG. 10, the components have been given the same last two digits as the corresponding component in the embodiment of FIG. 1. The frame assembly 112 differs slightly from the frame assembly 12 in that it includes a base frame 112B which does not have wheels. Additionally, the base frame 112B includes support legs 118 which pivot about vertical axes at the corners 118P of the base frame 112B.

As illustrated in FIG. 10, the base frame 112B is movable relative to the main frame 112M by members 156 telescoping into members 158 which are attached to the main frame 112M. More specifically, the members 156 may constitute hydraulic pistons which are extendable and retractable by varying pressure within hydraulic chambers inside of members 158. Various well known hydraulic arrangements could be used to provide powered hydraulic movement of the members 156 up and down relative to members 158.

With reference now to FIG. 11, a simplified top view showing the frame assembly 112 illustrates how the frame assembly 112 may be attached to a vehicle 146 having a single hitch 160 at one side and a double hitch 162 at another side, which hitches respectively mate to coupler parts 164 and 166 by respective pins or bolts 168 and 170. Nuts (not shown) may be used upon the bolts 168 and 170. The parts 164 and 166 are secured to the main frame 112M of the frame assembly 112. Continuing to consider FIG. 11, but also referring back to FIG. 12, it should be noted that the operation of the hydraulic members 156 and 158 allows one to lift the main frame 112M relative to the base frame 112B until the main frame 112M is at the proper height to secure parts 164 and 166 to the vehicle. This securing of the main frame 112M to the vehicle 146 allows one to then lift the base frame 112B relative to the main frame 112M by operation of the hydraulic members 156 and 158. The members 156 and 158 serve as the frame lifters such that the base frame 112B will be lifted off the ground. In identical fashion, the embodiment of FIG. 1 provides for its main frame 112M to be secured to the vehicle 46 such that the base frame 12B may be lifted off the ground to the position of FIG. 3.

Although the sequence of operations illustrated in FIGS. 4–8 show how the present crane 10 (or the modified version using frame assembly 112 of FIG. 10) may be used to quickly move loads such as battlefield magazines 50 along a predetermined path between a given starting point and a given finishing or unloading point, the crane 10 and its modified version 110 of FIG. 11 has additional flexiblity. As shown in FIG. 11, the posts 122 (only one shown in FIG. 11) are pivotably mounted by pivot 172 to the main frame 112M. Each of the pivots 172 (only one is illustrated in FIG. 11, it being understood that the other is identical) provides a vertical axis of rotation for a corresponding one of the booms 124. Pivots 172 serve as rotation means on each of the posts 122 to allow rotation of the booms 124 about vertical axes. The ball and socket joints which attach the cross-heads 126 to the booms 124 allow variation of the angles between the cross-head 126 and the booms 124. For example, the cross-head 126 could have less than a right angle between itself and the left boom 124 in the FIG. 11 view depending upon any adjustments to the length of the right boom 124 in FIG. 11. Cylinders 174 (only one shown in FIG. 11) is used to rotate or pivot the posts 122 in the fashion illustrated in FIG. 11. In similar fashion, hydraulic cylinders 74 (only one is illustrated in FIG. 1 for simplicity reasons) would be used in the crane 10 to provide movement of the crane 10 in similar fashion to movement of the crane 110 in FIG. 11.

FIG. 12 shows a third embodiment crane 210 according to the present invention and attached to a semi-trailer truck 276. The crane 210 is very similar in operation to the crane previously discussed and differences will be emphasized in the discussion which follows. The crane 210 includes a cross-head 226 which has a hook 278 instead of the fork assembly 34 illustrated in FIG. 1. The booms 224 of crane 210 use 4-piston hydraulic rotary actuators 280 for pivoting relative to the posts 222 instead of using the arm joints with pistons 28B and 28P illustrated in FIG. 1. Each of the hydraulic actuators 280 allows pivoting of the booms 224 about horizontal pivot axis corresponding to pivot points 224P. Each of the actuators 280 includes a central gear or sprocket 282 which rotates shaft 284. Shaft 284 is keyed or otherwise secured to cause rotation of the coresponding one of booms 224. The center sprocket 282 is rotated by movement of pistons 286 caused by hydraulic actuation of pistons 228. (As the hydraulic actuator 280 is constructed in symmetrical fashion, only one of the pistons 286 is completely illustrated and only two of the four pistons 288 are shown.) Hydraulic fluid is used to raise or lower the pistons 288 which in turn move pistons 286 causing rotation of center sprocket 282. The center sprocket 282 causes the booms 224 to pivot about horizontal pivot axes corresponding to points 224B.

The crane 210 is different from the previous cranes 10 and 110 in that its main frame 212M and base frame 212B are secured together. Accordingly, the crane 210 is simplified in that it does not include the lifting feature illustrated by FIG. 3.

Although various specific constructions have been discussed and shown, it is to be understood that these are for illustrative purposes only. Various modifications and adaptations will be readily apparent to those of skill in the art. Accordingly, the scope of the present invention should be determined by reference to the claims appended hereto.

What is claimed is:

1. A crane comprising:

(a) a frame assembly;

(b) first and second posts mounted to said frame assembly adjacent opposite sides thereof and extending up;

(c) a coupler mounted to an inner side of said frame assembly and operable to removably couple said crane to a vehicle;

(d) first and second booms, said first boom having an inner end mounted at a first pivot axis to said first post and an outer end, said second boom having an inner end mounted at a second pivot axis to said second post and an outer end;

(e) a crosshead attached to said outer end of said first boom and said outer end of said second boom; and (f) a load support attached to said crosshead and operable to support loads attached thereto for movement by said crane; and wherein said first and second booms are respectively pivotable in unison about first and second pivot axes over a range of at least 30° above horizontal in an outer direction towards an outer side opposite said inner side through 30° above horizontal in an inner direction towards said inner side, and wherein said crane is operable to move loads between said outer side and said inner side with the load support passing through a plane defined by said first and second booms, and further comprising a horizontal axis and pivot means and wherein said crosshead is pivotably mounted to each of said outer ends by said pivot means to allow it to pivot about said horizontal axis relative to said first and second booms.

2. The crane of claim 1 wherein said first and second pivot axis are both horizontal and said first and second booms are pivotable in unison over a range of at least below horizontal on said outer side to horizontal on said inner side.

3. The crane of claim 1 wherein each of said posts includes an upper part and a lower part and each upper part is vertically movable relative to each lower part to move said first and second booms.

4. The crane of claim 1 wherein each of said booms includes an inner part and an outer part movable relative to said inner part to change the straight line distance between said inner and outer ends.

5. A crane comprising:

(a) a frame assembly;

(b) first and second posts mounted to said frame assembly adjacent opposite sides thereof and extending up;

(c) a coupler mounted to an inner side of said frame assembly and operable to removably couple said crane to a vehicle;

(d) first and second booms, said first boom having an inner end mounted at a first pivot axis to said first post and an outer end, said second boom having an inner end mounted at a second pivot axis to said second post and an outer end;

(e) a crosshead attached to said outer end of said first boom and said outer end of said second boom; and (f) a load support attached to said crosshead and operable to support loads attached thereto for movement by said crane; and wherein said first and second booms are respectively pivotable in unison about first and second pivot axes over a range of at least 30° above horizontal in an outer direction towards an outer side opposite said inner side through 30° above horizontal in an inner direction towards said inner side, and wherein said crane is operable to move loads between said outer side and said inner side with the load support passing through a plane defined by said first and second booms, and further comprising two vertical axes, rotation means on each of said first and second posts, and pivot means on said crosshead and wherein the crosshead is at an angle relative to said first boom and is at an angle relative to said second boom and wherein each of said first and second booms is rotatable about one of said vertical axes by operation of the rotation means and said crosshead is mounted to each of said outer ends by said pivot means such that the angles between said crosshead and said first and second booms vary with rotation of said first and second booms about said vertical axes.

6. The crane of claim 5 further comprising a pair of wheels supporting said frame assembly and wherein the crane is operable to function as a trailer.

7. The crane of claim 6 further comprising a first support leg pivotably mounted to said frame assembly and wherein the crane is disposable in:

I. an operating configuration for lifting loads with said coupler attached to a vehicle such that the vehicle counterbalances any tendency of the crane to tip when supporting a load with said first and second booms extending away from the vehicle;

II. a stand-alone configuration with the crane at least partly supported by said first support leg pivoted to a lower position; and III. a towing configuration such that the crane is securable to a vehicle and having said first support leg pivoted to an upper position above its lower position.

8. A crane comprising:

(a) a frame assembly;

(b) first and second posts mounted to said frame assembly adjacent opposite sides thereof and extending up;

(c) a coupler mounted to an inner side of said frame assembly and operable to removably couple said crane to a vehicle;

(d) first and second booms, said first boom having an inner end mounted at a first pivot axis to said first post and an outer end, said second boom having an inner end mounted at a second pivot axis to said second post and an outer end;

(e) a crosshead attached to said outer end of said first boom and said outer end of said second boom; and (f) a load support attached to said crosshead and operable to support loads attached thereto for movement by said crane; and wherein said first and second booms are respectively pivotable in unison about first and second pivot axes over a range of at least 30° above horizontal in an outer direction towards an outer side opposite said inner side through 30° above horizontal in an inner direction towards said inner side, and wherein said crane is operable to move loads between said outer side and said inner side with the load support passing through a plane defined by said first and second booms, and further comprising a frame lifter operable to lift at least a portion of said frame assembly relative to the ground when said coupler is coupled to a vehicle such that the crane can be positioned by the vehicle while the crane is completely removed from the ground.

9. A crane comprising:

(a) a frame assembly;

(b) first and second posts mounted to said frame assembly adjacent opposite sides thereof and extending up;

(c) first and second booms, said first boom having an inner end mounted at a first pivot axis to said first post and an outer end, said second boom having an inner end mounted at a second pivot axis to said second post and an outer end;

(d) a cross head attached to said outer end of said first boom and said outer end of said second boom; and (e) a load support attached to said crosshead and operable to support loads attached thereto for movement by said crane; and further comprising two vertical axes, rotation means on each of said first and second posts, and pivot means on said crosshead, and wherein the crosshead is at an angle relative to said first boom and is at an angle relative to said second boom and wherein each of said first and second booms is rotatable about one of said vertical axes by operation of said rotation means and said crosshead is mounted to each of said outer ends by said pivot means such that the angles between said crosshead and said first and second booms vary with rotation in unison of both of said first and second booms about the vertical axes.

10. The crane of claim 9 further comprising a coupler mounted to an inner side of said frame assembly and operable to removably couple said crane to a vehicle.

11. The crane of claim 10 wherein said crosshead is attached to each of said first and second booms by a ball and socket.

12. The crane of claim 10 wherein said load support comprises a fork assembly having a hydraulically operated fork to lift and hook objects.

13. The crane of claim 10 further comprising a pair of wheels supporting said frame assembly and where the crane is operable to function as a trailer.

14. The crane of claim 13 wherein said first and second booms are respectively pivotable in unison about said first and second pivot axes over a range of at least 30° above horizontal in an inner direction towards said inner side, and wherein said crane is operable to move loads between said outer side and said inner side with the load support passing through a plane defined by said first and second booms.

15. The crane of claim 14 wherein the crane is disposable in:

I. an operating configuration for lifting loads with said coupler attached to a vehicle such that the vehicle counterbalances any tendency of the crane to tip when supporting a load by said first and second booms extending away from the vehicle;

II. a stand-alone configuration with the crane at least partly supported by said first support leg pivoted to a lower position; and III. a towing configuration such that the crane is securable to a vehicle and having said first support leg pivoted to an upper position above its lower position.

16. The crane of claim 13 further comprising a frame lifter operable to lift at least a portion of said frame assembly relative to the ground when said coupler is coupled to a vehicle such that the crane can be positioned by the vehicle while the crane is completely removed from the ground.

17. A crane comprising:

(a) a frame assembly;

(b) a pair of wheels supporting said frame assembly;

(c) a coupler mounted to a side of said frame assembly and operable to removably couple said crane to a vehicle;

(d) at least a first post mounted to said frame assembly;

(e) at least a first boom having an inner end mounted to said first post and an outer end;

(f) a load support supported by said outer end for supporting loads lifted by the crane; and (g) at least a first support leg pivotably mounted to said frame assembly; and wherein the crane is disposable in:

I. an operating configuration for lifting loads with said coupler attached to a vehicle such that the vehicle counterbalances any tendency of the crane to tip when supporting a load by said first boom extending away from the vehicle and with said first boom supported only at its inner end;

II. a stand-alone configuration with the crane at least partly supported by said first support leg pivoted to a lower position; and III. a towing configuration such that the crane is securable to a vehicle and having said first support leg pivoted to an upper position above its lower position and with said first support leg secured to said first boom; and further comprising a towing fastener and wherein said coupler is mounted to an inner side of said frame assembly and is operable to couple said crane to a vehicle with said inner side facing said vehicle, said frame assembly having an outer side which is opposite said inner side and when faces the vehicle when the crane is in its towing position and secured to the vehicle by said towing fastener.

18. The crane of claim 17 further comprising a second post, a second boom, and a second support leg, said second post being mounted to said frame assembly, said second boom having an inner end mounted to said second post and an outer end, said second support leg pivotably mounted to said frame assembly, and wherein the crane is at least partly supported in its stand-along configuration by said second support leg pivoted to a lower position, and wherein the towing configuration has said second support leg pivoted to an upper position above its lower position and with the second support leg secured to said second boom, and further comprising a crosshead attached between said first and second booms and having said load support mounted thereon.

19. The crane of claim 18 wherein said towing fastener is mounted to said crosshead for allowing a vehicle to pull said crane when it is in its towing position by way of said towing fastener.

20. The crane of claim 18 further comprising two vertical axes, rotation means on each of said first and second posts, and pivot means on said crosshead, and wherein the crosshead is at an angle relative to said first boom and is at an angle relative to said second boom and wherein each of said first and second booms is rotatable about one of said vertical axes by operation of sid rotation means and said crosshead is mounted to each of said outer ends by said pivot means such that the angles between said crosshead and said first and second booms vary with rotation in unison of both of said first and second booms about said vertical axes.

21. A crane comprising:

(a) a frame assembly;

(b) a pair of wheels supporting said frame assembly;

(c) a coupler mounted to a side of said frame assembly and operable to removably couple said crane to a vehicle;

(d) at least a first post mounted to said frame assembly;

(e) at least a first boom having an inner end mounted to said first post and an outer end;

(f) a load support supported by said outer end for supporting loads lifted by the crane; and (g) at least a first support leg pivotably mounted to said frame assembly; and wherein the crane is disposable in:

I. an operating configuration for lifting loads with said coupler attached to a vehicle such that the vehicle counterbalances any tendency of the crane to tip when supporting a load by said first boom extending away from the vehicle and with said first boom supported only at its inner end;

II. a stand-alone configuration with the crane at least partly supported by said first support leg pivoted to a lower position; and III. a towing configuration such that the crane is securable to a vehicle and having said first support leg pivoted to an upper position above its lower position and with said first support leg secured to said first boom; and further comprising a frame lifter operable to lift at least a portion of said frame assembly relative to the ground when said coupler is coupled to a vehicle such that the crane can be positioned by the vehicle while the crane is completely removed from the ground.

22. A crane comprising:

(a) a frame assembly;

(b) a first post mounted and extending up from said frame assembly;

(c) a coupler mounted to an inner side of said frame assembly and operable to removably couple said crane to a vehicle;

(d) a first boom having an inner end mounted to said first post and an outer end;

(e) a load support supported by said outer end for supporting loads lifted by the crane; and (f) a frame lifter operable to lift at least a portion of said frame assembly relative to the ground when said coupler is coupled to a vehicle such that the crane can be positioned by the vehicle while the crane is completely removed from the ground; and wherein said frame assembly includes a main frame and a base frame, and wherein said coupler is mounted to said main frame and said frame lifter lifts said base frame relative to said main frame.

23. The crane of claim 22 further comprising a second post and a second boom, said second post mounted and extending up from said frame assembly, and said second boom having an inner end mounted to said second post and an outer end.

24. The crane of claim 23 wherein said first and second booms are respectively pivotable in unison about horizontal first and second pivot axes over a range of at least 30° above horizontal in an outer direction towards an outer side opposite said inner side through 30° above horizontal in an inner direction towards said inner side, and wherein said crane is operable to move loads between said outer side and said inner side with the load support passing through a plane defined by said first and second crane arms.

25. The crane of claim 23 wherein each of said first and second booms is rotatable about a vertical axis and said crosshead is mounted to each of said outer ends such that the angles between said crosshead and said first and second booms vary with rotation in unison of both of said first and second booms.

26. The crane of claim 23 further comprising a first support leg pivotably mounted to said frame assembly and wherein said crane is disposable in:

I. an operating configuration for lifting loads with said coupler attached to a vehicle such that the vehicle counterbalances any tendency of the crane to tip when supporting a load by said first boom extending away from the vehicle;

II. a stand-alone configuration with the crane supported by said first support leg pivoted to a lower position; and III. a towing configuration such that the crane is securable to a vehicle and having said first support leg pivoted to an upper position above its lower position and with the first support leg secured to said first boom and the second support leg secured to said second boom.

* * * * *

UNITED STATES PATENT AND TRADEMARK OFFICE

CERTIFICATE OF CORRECTION

PATENT NO. : 4,818,172

DATED : April 4, 1989

INVENTOR(S) : JOHNSON, Bruce S.

It is certified that error appears in the above-identified patent and that said Letters Patent is hereby corrected as shown below:

Column 12, line 7, Claim 17, change "when" (first occurence) to -- which --.

Column 12, line 35, Claim 20, change "sid" to -- said --.

Signed and Sealed this

Fourteenth Day of November, 1989

*Attest:*

JEFFREY M. SAMUELS

*Attesting Officer* *Acting Commissioner of Patents and Trademarks*